United States Patent [19]

Wedel

[11] Patent Number: 4,880,502

[45] Date of Patent: Nov. 14, 1989

[54] PRESS DRYING APPARATUS WITH DEFLECTION CONTROL AND BLOW BOX COOLING

[75] Inventor: Gregory L. Wedel, Beloit, Wis.

[73] Assignee: Beloit Corporation, Beloit, Wis.

[21] Appl. No.: 84,655

[22] Filed: Aug. 11, 1987

[51] Int. Cl.[4] ..... D21F 3/02

[52] U.S. Cl. ..... 162/359; 162/206; 162/358; 162/360.1; 34/111; 34/123; 100/93 RP

[58] Field of Search ..... 162/206, 207, 358, 359, 162/360.1, 375, 290, 376, 377, 378, 305; 100/38, 93 RP; 34/110, 111, 116, 123

[56] References Cited

U.S. PATENT DOCUMENTS

| | | | |
|---|---|---|---|
| Re. 30,268 | 5/1980 | Justus | 162/358 |
| 2,981,175 | 4/1961 | Goyette | 162/206 |
| 3,799,052 | 3/1974 | Kusters et al. | 162/206 |
| 3,841,963 | 10/1974 | Schlunke | 162/93 RP |
| 4,324,613 | 4/1982 | Wahren | 162/206 |
| 4,586,984 | 5/1986 | Laapotti | 162/360.1 |
| 4,653,395 | 3/1987 | Verkasalo | 162/206 |
| 4,691,449 | 9/1987 | Wiberg | 34/111 |
| 4,738,752 | 4/1988 | Busker | 162/359 |

*Primary Examiner*—Karen M. Hastings

*Attorney, Agent, or Firm*—Dirk Veneman; Raymond Campbell; David J. Archer

[57] ABSTRACT

A press drying apparatus is disclosed for removing excess water from a formed web by the simultaneous application to the web of elevated temperature and pressure for a prolonged period of time. The apparatus includes a frame and a heated roll rotatably supported by the frame. A shoe is connected to the frame with the shoe cooperating with the heated roll for defining therebetween a first nip for the passage therethrough of the web. A deflection controller is connected to the frame with the controller cooperating with the heated roll for defining therebetween a second nip. The second nip is disposed diametrically opposite to the first nip such that when the web extends through the first nip and the heated roll is heated, deflection of the heated roll towards the second nip is compensated for by the deflection controller.

9 Claims, 3 Drawing Sheets

PRESS DRYING APPARATUS WITH DEFLECTION CONTROL AND BLOW BOX COOLING

BACKGROUND OF THE INVENTION

1. Field of the Invention

This invention relates to a press drying apparatus for removing excess water from a formed web by the simultaneous application to the web of elevated temperature and pressure for a prolonged period of time. More specifically, this invention relates to a press drying apparatus in which deflection of a heated roll is compensated for.

2. Information Disclosure Statement

In the papermaking art, excess water is removed from a formed web by passing the formed web through one or more pressing nips of a press section such that the pressed web entering the subsequent drying section requires the least amount of thermal energy in order to provide a web having the requisite moisture content. In practice, if more water can be removed during passage of the web through the press section, less heat is required in the drying section in order to obtain a resultant web having the right amount of moisture remaining. From the point of view of cost effectiveness alone, it is desirable to remove as much water as possible in the press section rather than attempting to remove it in the drying section. In view of the aforementioned objective of removing as much water as possible in the press section, proposals have been made to apply both pressure and externally-applied thermal energy to the press -section such that water within the formed web is vaporized during passage through the press drying nip. A prior art proposal of this type is disclosed in U.S. Pat. No. 4,324,613 to Wahren.

U.S. Pat. No. 4,324,613 shows a heated roll and a backing roll defining therebetween a press drying nip for passage therethrough of the formed web. The heated roll is heated by means of a burner such that the external surface of the heated roll is heated prior to rotation through the press drying nip.

Although the aforementioned proposal of U.S. Pat. No. 4,324,613 met with limited success in a laboratory application, this proposal was impractical when applied to a commercial press operation wherein web widths of up to 34 feet are commonplace. In commercial production, deflection, or bending of the press roll in a conventional or extended nip press roll, is compensated for by controlled crown roll means such that the nipping pressure applied at any point in a cross-machine direction remains substantially constant. Such crown controlled rolls typically include a central non-rotatable beam and a rotatable shell rotating around the fixed beam with a plurality of hydraulically-operated shoes disposed between the beam and the internal surface of the shell such that bowing (or deflection) of a cooperating backing roll is compensated for. Although, in conventional pressing techniques, including extended nip pressing techniques, such controlled crown rolls have met with considerable success, problems have existed when attempting to compensate for roll deflection when applying excessive heat to the heated press roll a in the press drying technique of the aforementioned U.S. Pat. No. 4,324,613.

Typically, the heated roll which may be up to 34 feet in width is heated within the range 300°–700° Fahrenheit. Additionally, the nip loading ranges from 300 to 6,000 pli. Such high temperatures cause serious problems when applying conventional crown control deflection techniques because the hydraulic fluid is excessively heated and oil seals tend to leak. Additionally, with the application of such excessive heat, the internal structure of such controlled crown rolls is subjected to very high thermal distortion.

The present invention overcomes the aforementioned problems by the provision of a heated roll of simple construction which is strong enough to withstand hoop stresses but which is able to bend, or deflect, under pressure. The aforementioned deflection is compensated for not by internal crown control deflection means but by the provision of a separate controlled crown roll which cooperates with the heated roll by defining a nip therebetween which is diametrically opposed to the aforementioned press drying nip.

Therefore, it is a primary objective of the present invention to provide a press drying apparatus which overcomes the aforementioned problems associated with the prior art proposals and which provides a significant contribution to the press drying art.

Another object of the present invention is the provision of a press drying apparatus which includes a heated roll and a pressing means which cooperates with the heated roll for defining therebetween a first nip for the passage therethrough of the web. A deflection controlling means cooperates with the heated roll for defining therebetween a second nip with the second nip being disposed diametrically opposite to the first nip such that when the web extends through the first nip and the heated roll is heated, deflection of the heated roll towards the second nip is compensated for by the deflection controlling means.

Another object of the present invention is the provision of a press drying apparatus in which a heated roll includes a shell having a thickness such that hoop stresses are supported while axial bending is permitted.

Another object of the present invention is the provision of a press drying apparatus in which an induction heater is disposed in close proximity to the heated roll for heating the heated roll.

Another object of the present invention is the provision of a press drying apparatus in which a pressing means includes an extended nip press shoe which defines a surface for cooperation with a heated roll, the shoe being urged towards the heated roll for defining therebetween a first nip.

Another object of the present invention is the provision of a press drying apparatus in which the deflection controlling means is a controlled crown roll.

Another object of the present invention is the provision of a press drying apparatus which includes a blow box disposed in close proximity to the controlling means such that a curtain of cooling air is blown against the controlling means to remove heat transmitted to the controlling means via the second nip.

Another object of the present invention is the provision of a press drying apparatus in which the controlling means is a second extended nip press.

Another object of the present invention is the provision of a press drying apparatus which includes a web guiding means which is disposed downstream relative to a press drying nip and upstream relative to a second calendering nip, the guiding means guiding the web from the first nip through the second nip.

Other objects and advantages of the present invention will be readily apparent to those skilled in the art by a consideration of the detailed description contained hereinafter taken in conjunction with the annexed drawings.

SUMMARY OF THE INVENTION

The present invention relates to a press drying apparatus and method for removing excess water from a formed web by the simultaneous application to the web of elevated temperature and pressure for a prolonged period of time. The apparatus includes a frame and a heated roll rotatably supported by the frame. A pressing means is connected to the frame with the pressing means cooperating with the heated roll for defining therebetween a first nip for the passage therethrough of the web. A deflection controlling means is connected to the frame with the controlling means cooperating with the heated roll for defining therebetween a second nip. The second nip is disposed diametrically opposite to the first nip such that when the web extends through the first nip and the heated roll is heated, deflection of the heated roll towards the second nip is compensated for by the deflection controlling means.

More specifically, the heated roll includes a shell having a thickness such that the hoop stresses are supported while axial bending is permitted. Furthermore, an induction heater is disposed in close proximity to the heated roll for heating the heated roll.

The pressing means includes an extended nip press shoe which defines a curved surface for cooperation with the heated roll. The shoe is urged towards the heated roll for defining therebetween the first nip with the first nip being a first extended nip. Hydraulic means urge the shoe toward the heated roll and a blanket extends through the first nip such that the blanket slides over, and relative to the shoe, so that the web is pressed between the blanket and the heated roll. A felt extends through the first nip such that the felt is disposed between the blanket and the web.

In a first embodiment of the present invention, the deflection controlling means is a controlled crown roll having a blow box disposed in close proximity to the controlling means for blowing a curtain of cooling air against the controlling means to remove heat transmitted to the controlling means through the second nip.

In a second embodiment of the present invention, the controlling means is a second extended nip press.

In a third embodiment of the present invention, the press drying apparatus further includes a web guiding means which is disposed downstream relative to the first nip and upstream relative to the second nip for guiding the web from the first nip through the second nip. The guiding means is disposed such that the web is guided around the guiding means from the press drying nip to, and through, the second nip such that the web is hot-calendered during passage through the second nip.

In a fourth embodiment of the present invention, the web extends through the press drying nip and remains in close proximity to the external surface of the heated roll so that the pressed web is guided to, and through, the second nip such that the pressed web is hot-calendered during passage through the second nip.

Although the present invention is described with certain particularity in the various embodiments described hereinafter, and as shown in the annexed drawings, it will be evident to those skilled in the art that many variations and modifications of the present invention can be carried out without departing from the spirit and scope of the present invention as defined by the appended claims. Included in such modifications, is an apparatus used for hot-calendering, or gloss calendering, in which the basis feature is that the heated roll has a deflection compensating nip.

Also included is the use of an extended nip press for deflection compensation, the extended nip press being applicable especially when the web passes through the second nip. Such disposition of the press is provided because otherwise additional heat would be removed from the hot roll in the second nip without any benefit. Furthermore, although more costly, two-deflection compensation nips could be applied instead of one.

Included in the present invention are heating means wherein the press roll is heated by flame, hot air impingement or hot oil or the like. The second nip can be used for dewatering instead for hot-calendering by adding another felt loop around the deflection compensating means.

BRIEF DESCRIPTION OF THE DRAWINGS

Similar reference characters refer to similar parts throughout the various embodiments of the present invention.

DETAILED DESCRIPTION OF THE INVENTION

Figure 1:
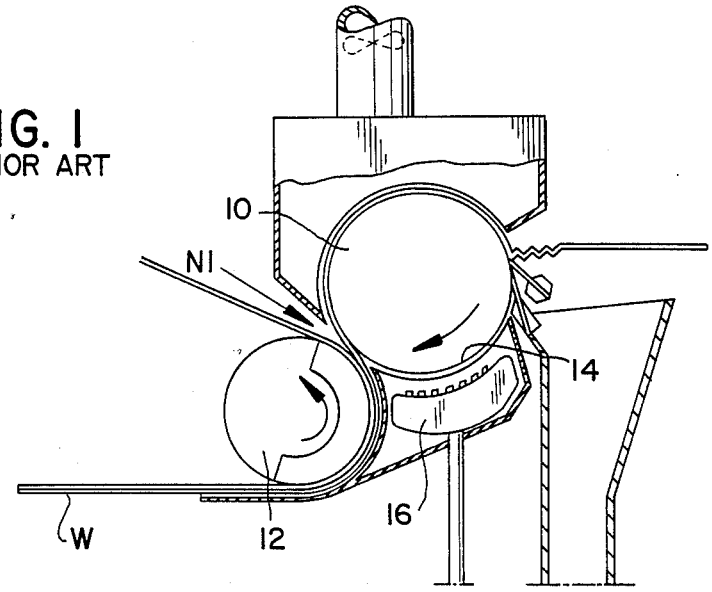
FIG. 1 PRIOR ART
FIG. 1 is a side-elevational view of a prior art press drying apparatus.

FIG. 1 is a side-elevational view of a prior art press drying apparatus as shown in U.S. Pat. No. 4,324,613. FIG. 1 shows a rotatable heated roll 10 which cooperates with a backing roll 12 for defining therebetween a press drying nip N1. The heated roll 10 defines an external surface 14 which is heated by a flame burner 16 such that the heated surface 14 is heated prior to rotation through the press drying nip N1. The application of high pressure and temperature during passage through the press drying nip N1 causes vaporization and removal of moisture from the formed web W.

The high pressure generated within the press drying nip N1 causes upward deflection, or bending or bowing, of the heated roll 10 such that the nip pressure applied along the cross-machine direction is non-uniform. Compensation by the provision of a controlled crown roll in place of the heated roll 10 would impose serious problems on the internal mechanism of such controlled crown roll seals and these problems would include leaking and loss of hydraulic fluid. These problems would be caused primarily because of the high temperatures which would be applied to the controlled crown roll. The aforementioned problem is overcome, according to the present invention, by the provision of a separate deflection controlling means as shown in FIGS. 2–5.

Figure 2:
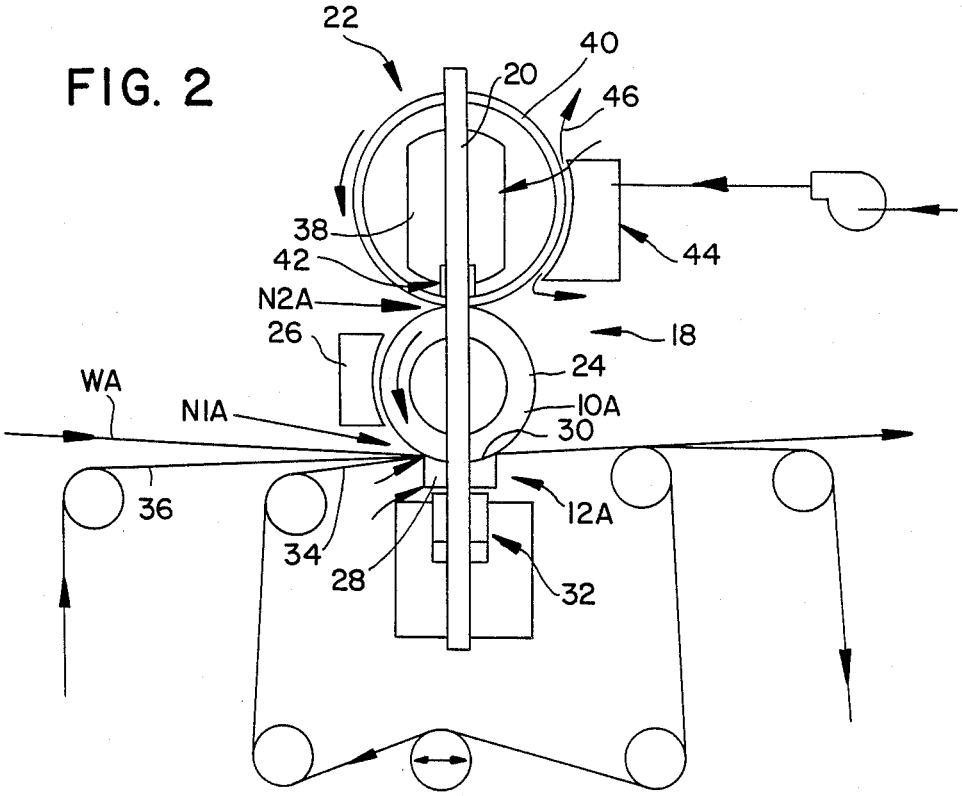
FIG. 2 is a side-elevational view of the press drying apparatus according to a first embodiment of the present invention.

FIG. 2 is a side-elevational view of a press drying apparatus generally designated 18 according to the present invention. The press drying apparatus 18 removes excess water from a formed web WA by the simultaneous application to the web WA of elevated temperature and pressure for a prolonged period of time. The apparatus 18 includes a frame 20 and a heated roll 10a rotatably supported by the frame 20. A pressing means generally designated 12A is connected to the frame 20. The pressing means 12A cooperates with the heated roll 10A for defining therebetween a first nip N1A for the passage therethrough of the web WA. A deflection controlling means generally designated 22 is connected to the frame 20. The controlling means 22 cooperates with the heated roll 10A for defining therebetween a second nip N2A. The second nip N2A is disposed diametrically opposite to the first nip N1A such that when the web WA extends through the first nip N1A and the heated roll 10A is heated, deflection of the heated roll 10A towards the second nip N2A is compensated for by the deflection controlling means 22.

As shown in FIG. 2, the heated roll 10A includes a shell 24 having a thickness such that hoop stresses are supported while axial bending is permitted. Furthermore, an induction heater 26 is disposed in close proximity to the heated roll 10A for heating the heated roll 10A. The press drying means 18 includes an extended nip press shoe 28 which defines a curved surface 30 for cooperation with the heated roll 10A. The shoe 28 is urged towards the heated roll 10A for defining therebetween the first nip N1A, the first nip N1A being a first extended nip. Hydraulic means generally designated 32 urge the shoe 28 towards the heated roll 10A and a blanket 34 extends through the first nip N1A with the blanket 34 sliding over, and relative to, the shoe 28 such that the web WA is pressed between the blanket 34 and the heated roll 10A. As shown in FIG. 2, the press drying apparatus 18 also includes a felt 36 which extends through the first nip N1A such that the felt 36 is disposed between the blanket 34 and the web WA.

In the first embodiment of the present invention as shown in FIG. 2, the deflection controlling means 22 is a controlled crown roll which includes a fixed beam 38, a rotatable shell 40 and a plurality of axially-disposed, hydraulically-controlled deflection pistons generally designated 42 for compensating for deflection of the heated roll 10A.

As shown in FIG. 2, the press drying apparatus 18 also includes a blow box means generally designated 44 which is disposed in close proximity to the controlling means 22 for blowing a curtain of cooling air indicated by the arrow 46 against the controlling means 22 to remove heat transmitted to the controlling means 22 through the second nip N2A.

Figure 3:
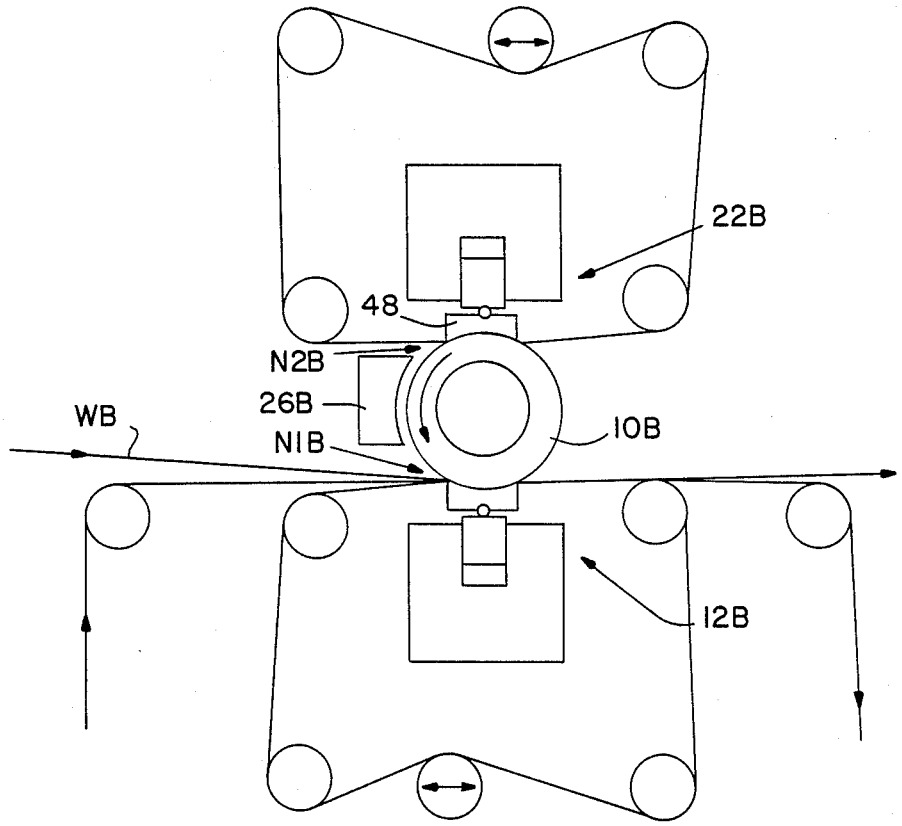
FIG. 3 is a side-elevational view of a second embodiment of the present invention.

FIG. 3 is a side-elevational view of a second embodiment of the present invention in which the controlling means 22B is a second extended nip press including a second extended nip press shoe 48.

Figure 4:
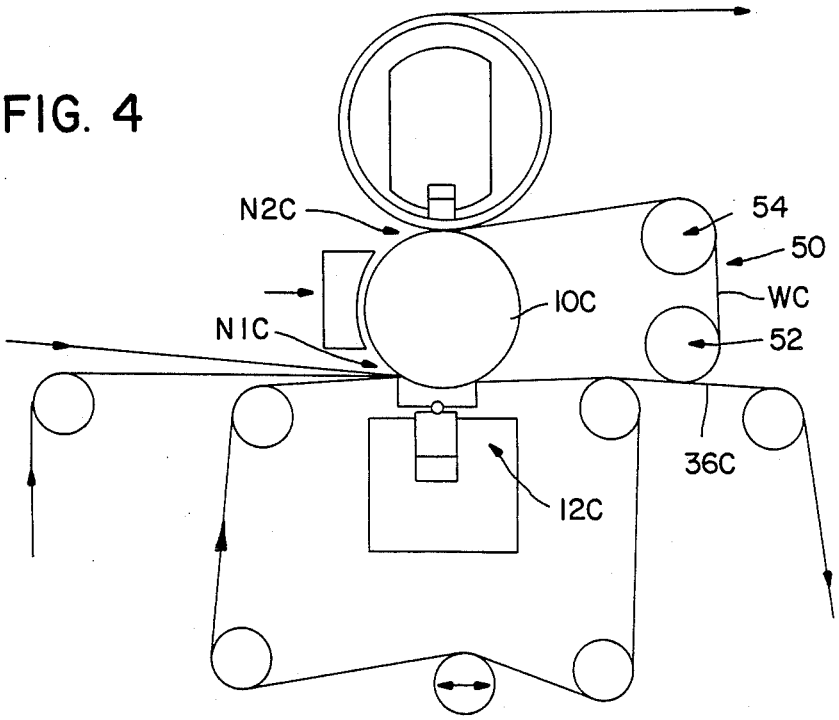
FIG. 4 is a side-elevational view of a third embodiment of the present invention.

FIG. 4 is a side-elevational view of a third embodiment of the present invention which shows a web guiding means generally designated 50 disposed downstream relative to the first nip N1C and upstream relative to the second nip N2C for guiding the web WC from the first nip N1C through the second nip N2C. More specifically, the guiding means 50 includes a first and second guide roll 52 and 54 respectively. Preferably the first guide roll 52 is a vacuum roll for assisting transfer of the web WC from the felt 36C such that the web WC may be guided to, and through, the second nip N2C for hot-calendering the pressed web WC.

Figure 5:
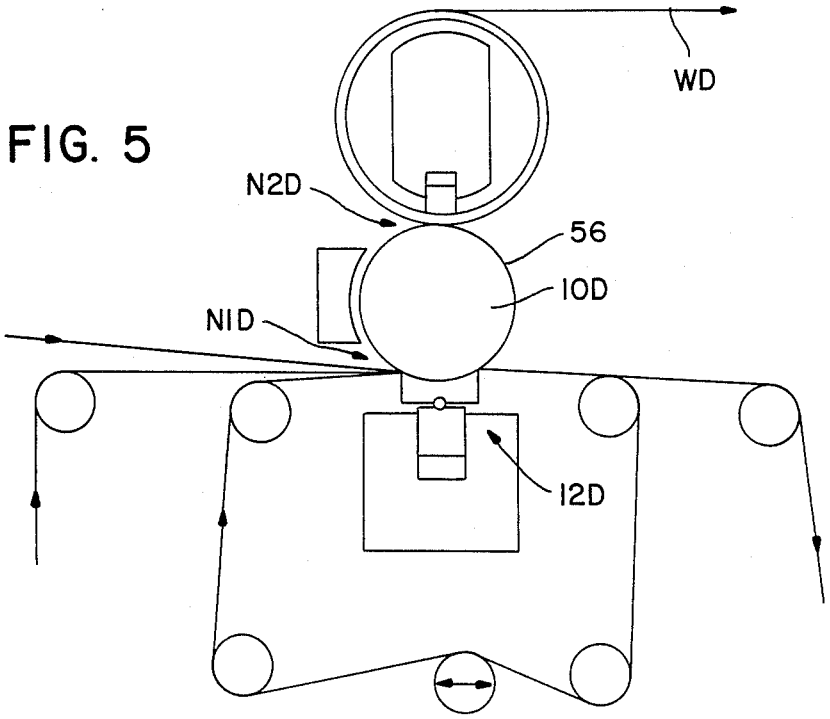
FIG. 5 is a side-elevational view of a fourth embodiment of the present invention.

FIG. 5 is a side-elevational view of a fourth embodiment of the present invention in which the press dried web WD disposed in close proximity to the outer surface 56 of the heated roll 10D is guided to, and through, the second nip N2D such that the web WD is hot-calendered during passage through the second nip N2D.

In operation of the press drying apparatus 18, according to the present invention, the induction heater 26 is energized during rotation of the heated roll 10A such that the shoe 28 is hydraulically urged towards the heated shell 24 so that the formed web WA is pressed and heated for a prolonged period of time during passage through the extended nip N1A. Bending, or deflection, of the heated roll 10A due to the elevated pressure applied to the extended nip N1A. is compensated for by the provision of the crown compensating roll 22 or second extended nip press 22B of the second embodiment.

Because the deflection controlling means 22 only contacts the heated roll 10A along a line contact at the second nip N2A, relatively little heat is transferred to the deflection controlling means 22 and this transferred thermal energy is easily removed by the application of the curtain of air 46 blown against the outer surface of the deflection controlling means 22.

In operation of the embodiment of FIGS. 4 and 5, the second nip N2C and N2D respectively, is utilized in order to apply a hot-calendering effect to the press dried web thereby providing an extremely compact papermaking process which may, or may not, avoid the subsequent necessity for a paper drying section.

The present invention enables the application of a press drying technique to a commercial papermaking operation by eliminating problems involved with the application of excessive heat to a deflection controlling means. Furthermore, the present invention provides a very compact pressing and drying operation which avoids the need for a subsequent conventional drying operation.

What is claimed is:

1. A press drying apparatus for removing excess water from a formed web by the simultaneous application to the web of elevated temperature and pressure for a prolonged period of time, said apparatus comprising:

a frame;

a roll rotatably supported by said frame;

induction heating means for heating said roll;

a pressing shoe connected to said frame, said pressing shoe cooperating with said roll for defining therebetween a first extended nip for the passage therethrough of the web;

a blanket extending through said first nip, said blanket sliding over, and relative to, said shoe such that the web is pressed between said blanket and said roll, the web being in physical contact with said roll;

a single felt extending through said first nip such that said felt is disposed between said blanket and the web; and a deflection controlling means connected to said frame, said controlling means cooperating with said roll for defining therebetween a second nip, said second nip being disposed diametrically opposite to said first nip such that when the web extends through said first nip and said roll is heated by said heating means, deflection of said heated roll towards said second nip is compensated for by said deflection controlling means and a blow box means disposed in close proximity to said deflection controlling means for blowing a curtain of cooling air against said deflection controlling means to remove heat transmitted to said deflection controlling means through said second nip.

2. A press drying apparatus as set forth in claim 1 wherein said shoe defines a curved surface for cooperation with said roll, said shoe being urged towards said roll for defining therebetween said first nip;

hydraulic means for urging said shoe towards said roll.

3. A press drying apparatus as set forth in claim 1 wherein said deflection controlling means is a controlled crown roll.

4. A press drying apparatus as set forth in claim 1 wherein said deflection controlling means is a second extended nip press.

5. A press drying apparatus as set forth in claim 1 further including:

web guiding means disposed downstream relative to said first nip and upstream relative to said second nip for guiding the web from said first nip through said second nip.

6. A press drying apparatus as set forth in claim 5 wherein said guiding means further includes a first and second guide roll.

7. A press drying apparatus as set forth in claim 6 wherein at least one of said guide rolls is a vacuum roll.

8. A press drying apparatus as set forth in claim 1 structured so that the web is guided directly around and on said roll from said first nip towards, and through, said second nip such that the web is hot-calendered during passage through said second nip.

9. A press drying apparatus for removing excess water from a formed web by the simultaneous application to the web of elevated temperature and pressure for a prolonged period of time, said apparatus comprising:

a frame;

a roll rotatably supported by said frame;

induction heating means for heating said roll;

a pressing shoe cooperating with said roll for defining therebetween a first extended nip for the passage therethrough of the web;

a blanket extending through said first nip, said blanket sliding over, and relative to, said shoe such that the web is pressed between said blanket and said roll, the web being in physical contact with said roll;

a single felt extending through said first nip such that said felt is disposed between said blanket and the web;

a deflection controlling means connected to said frame, said controlling means cooperating with said roll for defining therebetween a second nip, said second nip being disposed diametrically opposite to said first nip such that when the web extends through said first nip and said roll is heated by said heating means, deflection of said roll towards said second nip is compensated for by said deflection controlling means; and a web guide means disposed downstream relative to said first nip and upstream relative to said second nip for guiding the web emerging from said first nip to, and through, said second nip such that the web is hot calendered during passage through said second nip and a blow box means disposed in close proximity to said deflection controlling means for blowing a curtain of cooling air against said deflection controlling means to remove heat transmitted to said deflection controlling means through said second nip.

* * * * *